US007384434B2

(12) United States Patent
Malfer et al.

(10) Patent No.: US 7,384,434 B2
(45) Date of Patent: Jun. 10, 2008

(54) REACTION OF PHENOLS WITH INTERMEDIATE TRIAZINES

(75) Inventors: Dennis J. Malfer, Glen Allen, VA (US); May D. Thomas, Richmond, VA (US); William J. Colucci, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 600 days.

(21) Appl. No.: 10/860,364

(22) Filed: Jun. 3, 2004

(65) Prior Publication Data

US 2005/0268538 A1 Dec. 8, 2005

(51) Int. Cl.
*C10L 1/18* (2006.01)

(52) U.S. Cl. ..... 44/415; 564/336

(58) Field of Classification Search ..... 44/415, 44/424; 564/336

See application file for complete search history.

(56) References Cited

U.S. PATENT DOCUMENTS

| | | | | | |
|---|---|---|---|---|---|
| 3,634,515 | A * | 1/1972 | Piasek et al. | ..... | 564/368 |
| 3,649,229 | A * | 3/1972 | Otto | ..... | 44/347 |
| 3,798,247 | A * | 3/1974 | Piasek et al. | ..... | 508/453 |
| 3,809,648 | A * | 5/1974 | Hotten | ..... | 508/375 |
| 3,980,569 | A * | 9/1976 | Pindar et al. | ..... | 508/542 |
| 4,025,451 | A | 5/1977 | Plonsker et al. | | |
| 5,017,299 | A * | 5/1991 | Gutierrez et al. | ..... | 508/558 |
| 5,109,062 | A * | 4/1992 | Robinson et al. | ..... | 524/801 |
| 5,354,453 | A * | 10/1994 | Bhatia | ..... | 208/236 |
| 5,514,190 | A | 5/1996 | Cunningham et al. | | |
| 5,697,988 | A | 12/1997 | Malfer et al. | | |
| 5,876,468 | A | 3/1999 | Moreton | | |
| 6,048,373 | A | 4/2000 | Malfer et al. | | |
| 6,270,539 | B1 | 8/2001 | Henly | | |

FOREIGN PATENT DOCUMENTS

| | | |
|---|---|---|
| DE | 109498 | 3/1898 |
| DE | 433100 | 8/1926 |
| EP | 05253437.7 | 7/2005 |

OTHER PUBLICATIONS

Database Beilstein 1988, XP002345880, Database accession No. Reaction IDs: 1635211, 2187380 and 2187400 abstract & Moehrle et al: Archiv Der Pharmazie, vol. 315, No. 7, 1982, pp. 619-630.
Database Beilstein 1988, XP002345879, Database accession No. Reaction ID: 187744 abstract & Mahajani et al: Journal of the Indian Chemical Society, vol. 33, 1956, pp. 455-457.
Database Beilstein 1988, XP002345878, Database accession No. Reacion ID: 3769949 abstract & Amer et al: Journal of the Chemical Society. Perkin Transactions 1, vol. 5, 1983, pp. 1075-1082.

(Continued)

*Primary Examiner*—Cephia D. Toomer
(74) *Attorney, Agent, or Firm*—Fitch, Even, Tabin & Flannery

(57) ABSTRACT

An improved process for preparing a Mannich product employs an intermediate or pre-formed triazine. The product is useful as a detergent in fuel compositions. The fuel compositions containing the Mannich product are useful for controlling intake valve deposits in engines.

2 Claims, 1 Drawing Sheet

OTHER PUBLICATIONS

Chandrasekaren et al: "A New Class of Silatranes: Structure and Dynamic NMR Behavior" Journal of the Americal Chemical Society, vol. 122, 2000, pp. 1066-1072, XP002345980 p. 1067; compound 5.

Kickelbick et al: "Synthesis of Hexadentate Hexahydro-1, 3, 5-triazine-Based Ligands and their Copper (I) Complex" Monatshefte Fur Chemie, vol. 133, 2002, pp. 1157-1164, XP002345981 p. 1162; compound 1.

* cited by examiner

REACTION OF PHENOLS WITH INTERMEDIATE TRIAZINES

FIELD

The present invention relates to the preparation of a Mannich product via a hexahydrotriazine intermediate. The Mannich product may be useful as an additive in compositions such as, e.g., fuel compositions.

INTRODUCTION

Fuels used in internal combustion engines generally contain performance-enhancing additives. These additives often lead to the formation of undesirable engine deposits. It is believed that these additives negatively affect engine performance by, for example, clogging fuel induction systems. Considerable research has been devoted to additives for controlling (preventing or reducing) deposit formation in internal combustion engines. The preparation and identification of fuel additives capable of controlling undesirable deposit formation has been a focal point of this research.

Compositions comprising Mannich products have previously been used as fuel additives for controlling deposit formation. Mannich products may be obtained by reacting an aldehyde, an amine, and a hydroxyl aromatic compound. These Mannich products may be combined with other ingredients to form detergent compositions.

U.S. Pat. No. 4,117,011 discloses the use of Mannich products as dispersants/detergents for lubricating oils and hydrocarbon fuels. The products are obtained by reacting hydrocarbon-substituted phenols, aldehydes, amines and alkylene oxides. Suitable reactants disclosed therein include substituted phenols, formaldehyde, and alkylene polyamines, such as diethylene triamine.

U.S. Pat. No. 5,514,190 discloses gasoline compositions containing Mannich detergents, poly(oxyalkylene) carbamates and poly(oxyalkylene) alcohols. These compositions may additionally contain hydrocarbon diluents, solvents or carriers including polymers of lower hydrocarbons such as polypropylene, polyisobutylene and ethylene-1-olefin copolymers.

Prior art processes for preparing Mannich products are accompanied by certain disadvantages, such as inconsistent product yields. For example, in the instance where primary amines are used as a reactant, a product mixture is obtained. It may be desirable to obtain a consistent product mixture. However, the conventional Mannich process combining formaldehyde, an amine, and a hydroxyaromatic can give variations in the product mixture based on the distillation of water and co-distillation of the more volatile starting materials with water (which requires the need for disposal of additional solvent). This and other disadvantages may be overcome by preparing a Mannich product via an intermediate triazine. This process eliminates the need for at least one distillation step commonly used in prior art processes, and also may allow for the formation of a consistent product mixture while minimizing the problem of solvent disposal.

SUMMARY

According to one aspect of the disclosure, there is provided a process for preparing a Mannich product, comprising reacting a primary amine with an aldehyde to yield an optionally substituted hexahydrotriazine, and reacting the optionally substituted hexahydrotriazine with an optionally substituted hydroxyaromatic compound to yield a Mannich product.

According to another aspect of the disclosure, there is provided a process for preparing a fuel additive, comprising reacting the condensation product of an aldehyde and a primary amine with an optionally substituted hydroxyaromatic compound to yield a fuel additive, wherein the condensation product is an optionally substituted hexahydrotriazine.

According to another aspect of the disclosure, there is provided a process for preparing a composition comprising at least one aminophenol, said process comprising reacting an optionally substituted hexahydrotriazine with an optionally substituted hydroxyaromatic compound.

According to another aspect of the disclosure, there is provided a process for preparing a Mannich product, comprising reacting N,N-dimethyl-1,3-propane diamine with formaldehyde to yield 1,3,5-tris(3-(dimethylamino)propyl) hexahydro-1,3,5-triazine, and reacting said 1,3,5-tris(3-(dimethylamino)propyl) hexahydro-1,3,5-triazine with polyisobutylcresol to yield the Mannich product.

According to another aspect of the disclosure, there is provided a fuel additive composition comprising a Mannich product, wherein the Mannich product is prepared by combining a preformed optionally substituted hexahydrotriazine with an optionally substituted hydroxyaromatic compound to yield the Mannich product.

It is to be understood that both the foregoing general description and the following description of various embodiments are exemplary and explanatory only and are not restrictive.

BRIEF DESCRIPTION OF THE DRAWING

The accompanying drawing, which is incorporated in and constitutes a part of this specification, illustrates an exemplary embodiment.

DESCRIPTION OF VARIOUS EMBODIMENTS

Figure 1:
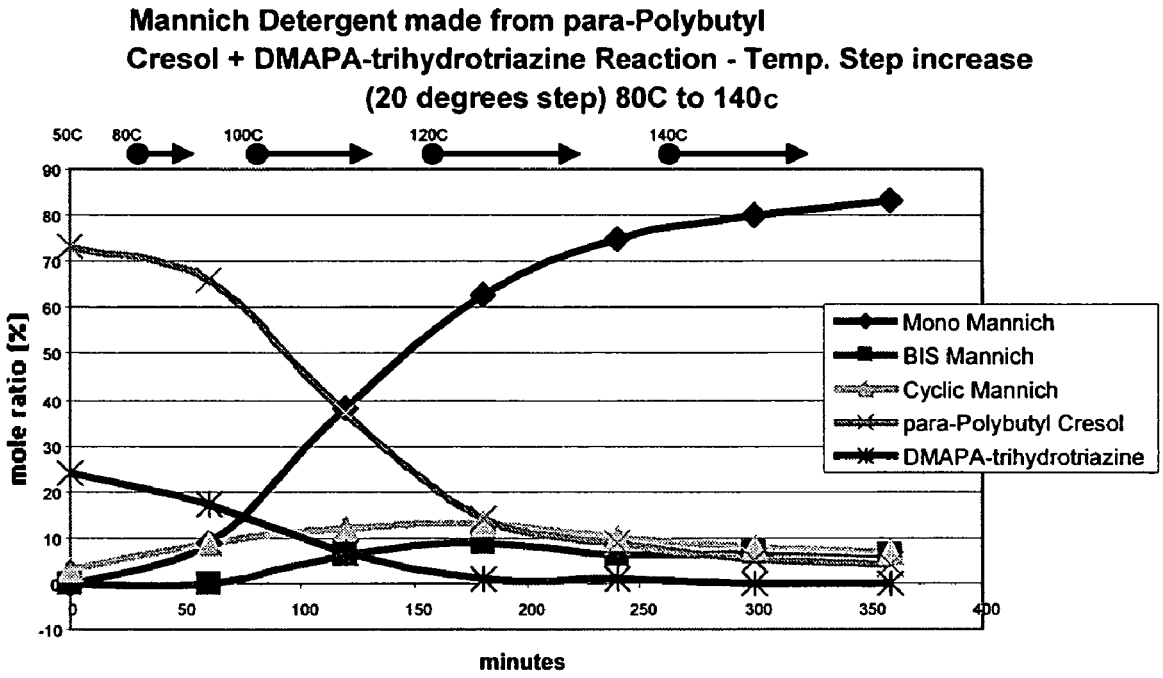
FIG. 1 illustrates the molar ratio of reactants and products during the preparation of a Mannich product.

An improved process for preparing a Mannich product is disclosed herein. The Mannich products may be obtained by condensing a primary amine with an aldehyde to yield a hexahydrotriazine intermediate, and then reacting this triazine intermediate with an optionally substituted hydroxyaromatic compound to yield a consistent product mixture without distillation of water. The process may be equally suitable under either batch or continuous process conditions.

Alternatively, the Mannich products may be prepared by reacting the pre-formed hexahydrotriazine with a hydroxyaromatic compound, suitably without distillation of water. By using this pre-formed triazine, a consistent product ratio may be obtained. In addition, solvent disposal problems are minimized because the loss of starting materials in the overhead during the process is negligible. This process is also suitable under either batch or continuous process conditions.

Amines suitable for the process of the present disclosure include, but are not limited to, molecules having at least one suitably reactive primary amine moiety that may react with an aldehyde to form a triazine. The amines can be further substituted with other groups, for example, hydroxyl, cyano, amido, and halogen. By way of non-limiting examples, the amines may be chosen from aliphatic amines containing 1 to 20 carbon atoms such as methylamine, ethylamine, n-propylamine, n-butylamine, isobutylamine, sec-butylamine, n-hexylamine, 2-ethylhexylamine, laurylamine, oleylamine, stearylamine, and eicosylamine. Another suitable class of amines for the purposes of the present disclosure includes polyamines, such as polyalkylenepolyamines, for example polyethylenepolyamines. They can be represented by the following formula:

$$H_2N—(CH_2—CH_2NH)_x—H$$

wherein x is an integer ranging from 1 to 6. They can be used individually or as a mixture. Suitable non-limiting examples of polyethylene polyamines include ethylenediamine, diethylenetriamine, triethylenetetramine, and tetraethylenepentamine. Corresponding polypropylene polyamines may also be suitable reactants. The alkylene polyamines may be obtained from the reaction of ammonia and dihalo alkanes, such as dichloroalkanes. According to one aspect of the disclosure, a suitable polyamine is N,N-dimethyl-1,3-propane diamine.

The aldehyde reactant can be any aldehyde, for example those containing from 1 to 6 carbon atoms such as formaldehyde, acetaldehyde, propionaldehyde, butyraldehyde, valeraldehyde, hexaldehyde, and the like. Aldehyde reactants suitable for the purposes of the present disclosure include the low molecular weight aliphatic aldehydes containing from 1 to 4 carbon atoms such as formaldehyde, acetaldehyde, butyraldehyde, isobutyraldehyde, and the like. According to one aspect of the disclosure, the aldehyde is formaldehyde, which may be used in its monomeric or polymeric form such as paraformaldehyde. Aldehyde precursors may also be used as the aldehyde reactant.

In accordance with the present disclosure, the intermediate or pre-formed triazine is reacted with an optionally substituted hydroxyaromatic compound. The hydroxyaromatic compound will advantageously have at least one unsubstituted position ortho to the hydroxyl moiety. The hydroxyaromatic compound may be optionally substituted with at least one substituent other than the hydroxyl moiety. For example, the at least one substituent may be chosen from alkyl and alkenyl moieties, such as $C_1$-$C_4$ alkyl and alkenyl moieties. Representative examples of hydroxyaromatic compounds useful in the process disclosed herein include phenolic compounds, including alkyl-substituted phenols. Phenolic compounds that may be used include high molecular weight alkyl-substituted derivatives of resorcinol, hydroquinone, cresol, catechol, xylenol, hydroxydiphenyl, benzylphenol, phenethylphenol, naphthol, and tolylnaphthol, among others, all of which may be optionally further substituted with any other substituent that will not interfere, or at least substantially interfere, with the reaction with the triazine.

Mention may also be made of polypropylphenol (formed by alkylating phenol with polypropylene), polybutylphenols (formed by alkylating phenol with polybutenes and/or polyisobutylene), and polybutyl-co-polypropylphenols (formed by alkylating phenol with a copolymer of butylene and/or butylene and propylene). Other similar long-chain alkylphenols may also be used. Examples include phenols alkylated with copolymers of butylene and/or isobutylene and/or propylene, and one or more mono-olefinic comonomers copolymerizable therewith (e.g., ethylene, 1-pentene, 1-hexene, 1-octene, 1-decene, etc.) where the copolymer molecule contains at least 50% by weight of butylene and/or isobutylene and/or propylene units. Such compounds may be further substituted with, e.g., alkyl groups, for example $C_1$-$C_4$ alkyl groups such as methyl. According to one aspect of the present disclosure, a suitable hydroxyaromatic compound is polyisobutylcresol. The comonomers polymerized with propylene or said butenes may be aliphatic and can also contain non-aliphatic groups, e.g., styrene, o-methylstyrene, p-methylstyrene, divinyl benzene and the like. Thus, in any case the resulting polymers and copolymers used in forming the alkyl-substituted hydroxyaromatic compounds may be substantially aliphatic hydrocarbon polymers.

Polybutylphenol (formed by alkylating phenol with polybutylene) is suitable for the purposes of the present disclosure. The polybutylphenol ring may be further substituted with, for example, alkyl groups, such as lower, e.g., $C_1$-$C_4$, alkyl groups, for example methyl. According to one aspect of the present disclosure, the polybutylphenol is polyisobutylcresol. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polybutylenes having relatively high proportions of polymer molecules having a terminal vinylidene group, formed by methods such as described, for example, in U.S. Pat. No. 4,152,499 and W. German Offenlegungsschrift 29 04 314, are also suitable for use in forming the long chain alkylated phenol reactant.

The alkylation of the hydroxyaromatic compound may be performed in the presence of an alkylating catalyst at a temperature ranging from about 50 to about 200° C. Acidic catalysts are generally used to promote Friedel-Crafts alkylation. Typical catalysts used in commercial production include but are not limited to sulphuric acid, $BF_3$, aluminum phenoxide, tin chloride, methane-sulphonic acid, cationic exchange resin, acidic clays, and modified zeolites.

The long chain alkyl substituents on the benzene ring of the phenolic compound may be derived from polyolefins having a number average molecular weight of from about 500 to about 3000 (for example, from about 500 to about 2000) as determined by gel permeation chromatography (GPC). The polyolefin may also have a polydispersity (weight average molecular weight/number average molecular weight) in the range of about 1 to about 4, for example from about 1 to about 2, as determined by GPC.

According to certain aspects of the present disclosure, polyalkylphenol reactants, e.g., polypropylphenol and polybutylphenol whose alkyl groups have a number average molecular weight of about 650-1200, are suitable for the preparation of Mannich products. According to certain embodiments, an alkyl group useful in accordance with the present disclosure is a polybutyl group derived from polybutylene having a number average molecular weight in the range of about 650-950.

According to certain aspects of the present disclosure, suitable configuration of the alkyl-substituted hydroxyaromatic compound is that of a para-substituted mono-alkylphenol. However, any alkylphenol readily reactive in the Mannich reaction may be employed, including those having at least one unsubstituted position ortho to the hydroxyl moiety. Thus, Mannich products made from hydroxyaromatic compounds having only one ring alkyl substituent, or at least two ring alkyl substituents are suitable for use in accordance with the present disclosure. The long chain alkyl substituents may contain some residual unsaturation, or may be substantially saturated alkyl groups. According to certain embodiments, the long chain alkyl groups are partially unsaturated. According to one aspect of the disclosure, the long-chain alkyl groups have a degree of unsaturation ranging from 5 to 80%, for example from 10 to 50%.

According to one aspect of the present disclosure, an amine and an aldehyde are condensed to form the hexahydrotriazine intermediate, and this triazine intermediate is subsequently reacted with a hydroxyaromatic compound to yield the Mannich product. The condensation between the aldehyde and the amine may be conducted at a temperature ranging from about 30° C. to about 200° C., for example at a temperature ranging from 40° C. to about 150° C. The condensation reaction can be conducted in bulk (no diluent or solvent), or in a solvent or diluent. Suitable solvents or diluents include those that are inert and/or may be easily removed if desired, such as organic solvents, for example aromatic solvents, such as benzene, xylene, or toluene. Typically, the amine and aldehyde are reacted in a ratio of 0.5-3:1.0-3.0, for example 1:3 to 3:1, such as 1:1. According to one aspect of the present disclosure, the aldehyde may be present in a molar amount at least equal to the total molar amount of the amine compound present.

When the condensation reaction between the amine and the aldehyde is complete or substantially complete, a hexahydrotriazine intermediate is obtained. This triazine intermediate may then be combined with the optionally substituted hydroxyaromatic compound to yield the Mannich product. According to one aspect of the disclosure, the triazine intermediate reacts with the optionally substituted hydroxyaromatic compound without heating. According to an aspect of the present disclosure, the reaction is conducted without removal of water, e.g., without azeotropic distillation of water. The hexahydrotriazine intermediate and the optionally substituted hydroxyaromatic compound may be combined in a ratio of 0.1-4.0:4-1.0, for example 1:3 to 3:1. According to one aspect of the present disclosure, the ratio is 1:3.

According to another aspect of the present disclosure, the triazine is pre-formed, e.g., the Mannich product is prepared directly from a pre-formed triazine and the optionally substituted hydroxyaromatic compound. The pre-formed triazine is optionally substituted with at least one substituent, for example alkyl or alkenyl substituents. According to an aspect of the disclosure, the pre-formed triazine is optionally substituted with at least one aminoalkyl substituent, for example a dialkylaminoalkyl substituent. One pre-formed triazine suitable for the purpose of the present disclosure is 1,3,5-tris(3-(dimethylamino)propyl) hexahydro-1,3,5-triazine. This hexahydrotriazine may be prepared as described in the present disclosure, and also may be obtained from other sources, for example from Huntsman Chemical as well as Aldrich Chemical. As with the intermediate hexahydrotriazine, this pre-formed triazine and the optionally substituted hydroxyaromatic compound may be combined in a ratio of 0.1-4.0:4-1.0, for example 1:3 to 3:1. According to one aspect of the present disclosure, the ratio is 1:3. The reaction may optionally be conducted at a consistent temperature and/or without the application of heat. The reaction is optionally conducted in the presence of a solvent or diluent such as one which is easily removed and/or inert, including organic solvents, for example aromatic solvents such as benzene, xylene, or toluene. The reaction is optionally conducted in an inert atmosphere, such as under a nitrogen blanket.

When formulating the fuel compositions in accordance with the present disclosure, the Mannich product (with or without other additives) is employed in an amount sufficient to reduce or inhibit deposit formation in an internal combustion engine. Thus, the fuels will contain a minor amount of the Mannich product that may prevent or reduce formation of engine deposits, including intake system deposits, for example intake valve deposits in spark-ignition internal combustion engines. By way of non-limiting examples, the fuel compositions in accordance with the present disclosure may contain, on an active ingredient basis, an amount of Mannich product in the range of about 5 to about 50 ptb (pounds by weight of additive per thousand barrels by volume of fuel), for example an amount ranging from about 15 to about 40 ptb.

The fuel compositions of the present disclosure may contain at least one supplemental additive in addition to the Mannich product. The at least one supplemental additive may be chosen from, for example, dispersants, detergents, antioxidants, carrier fluids, metal deactivators, dyes, markers, corrosion inhibitors, biocides, antistatic additives, drag-reducing agents, demulsifiers, dehazers, anti-icing additives, anti-knock additives, anti-valve-seat recession additives, lubricity additives, and combustion improvers. The at least one supplemental additive may be provided in the fuel composition in an amount necessary to achieve the desired effect.

The base fuels used in formulating the fuel compositions according to the present disclosure include any base fuels suitable for use in the operation of spark-ignition internal combustion engines, such as leaded or unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Suitable oxygenates include, for example, methanol, ethanol, isopropanol, t-butanol, mixed $C_1$ to $C_5$ alcohols, methyl tertiary butyl ether, tertiary amyl methyl ether, ethyl tertiary butyl ether, and mixed ethers. Oxygenates, when used, will normally be present in the base fuel in an amount below about 25% by volume, for example in an amount that provides an oxygen content in the overall fuel in the range of about 0.5 to about 5% by volume.

According to one aspect of the present disclosure, the Mannich products may be used in combination with at least one liquid carrier or induction aid. Such carriers can be of various types such as, for example, liquid poly-α-olefin oligomers, mineral oils, liquid poly(oxyalkylene) compounds, liquid alcohols or polyols, polyalkenes, liquid esters, and similar liquid carriers. Mixtures of two or more such carriers can be employed.

Exemplary liquid carriers include 1) a mineral oil or a blend of mineral oils that have a viscosity index of less than about 120, 2) at least one poly-α-olefin oligomer, 3) at least one poly(oxyalkylene) compound having an average molecular weight in the range of about 500 to about 3000, 4) polyalkenes or 5) any combination of mixture thereof. The mineral oil carriers that can be used include paraffinic, naphthenic and asphaltic oils, and can be derived from various petroleum crude oils and processed in any suitable manner. For example, the mineral oils may be solvent extracted or hydrotreated oils. Reclaimed mineral oils can also be used. In accordance with certain aspects of the present disclosure, the mineral oil used has a viscosity at 40° C. of less than about 1600 SUS, for example between about 300 and 1500 SUS at 40° C. Paraffinic mineral oils suitably have viscosities at 40° C. in the range of about 475 SUS to about 700 SUS. According to certain aspects of the present disclosure, the mineral oil has a viscosity index of less than about 100, for example less than about 70, such as in the range of from about 30 to about 60.

In some cases, the Mannich product can be synthesized in the carrier fluid. In other instances, the pre-formed Mannich product is blended with a suitable amount of the carrier fluid.

If desired, the Mannich product can be formed in a suitable carrier fluid and then blended with an additional quantity of the same or a different carrier fluid.

The additives used in formulating the fuels disclosed herein can be blended into the base fuel individually or in various sub-combinations. However, it may be desirable in some instances to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, use of a concentrate may reduce blending time and may lessen the possibility of blending errors.

Other aspects of the present invention include methods for reducing intake valve deposits and eliminating valve sticking in a spark-ignition engine by fueling and/or operating the engine with the fuel composition disclosed herein.

Reference will now be made to an exemplary embodiment, which is illustrated in the accompanying drawing.

EXAMPLE

The following example illustrates the preparation of a Mannich product from p-polybutyl cresol ("PB-cresol") and pre-formed 1,3,5-tris(3-(dimethylamino)propyl) hexahydro-1,3,5-triazine ("DMAPA-triazine").

A 1-liter flask was provided and configured for heating and stirring its contents under a nitrogen blanket. 300 g of PB-cresol was stirred and heated with 108.5 g of an aromatic 100 solvent [this solvent is a mixture of xylenes and mesitylenes and is known as Aromatic 100] to a temperature of 45° C. 25.5 g of the DMAPA-hexahydrotriazine was added by use of an equilibrating addition funnel over a 3 to 5 minute period. The reaction mixture was monitored during the reaction period by taking samples every hour for analysis by C-13 NMR. The temperature warmed upon addition of the DMAPA-triazine to 47° C. (+2° C. exotherm). The temperature set point was then gradually raised to 140° C. for 2 hours. The reaction product was allowed to cool to room temperature, and was placed in a storage container. The C-13 NMR quantified results were plotted (see FIG. 1) to observe the ratio of Mannich products.

The use of pre-formed triazine, as in the above example, may provide certain advantages. For example, there is little or no aqueous distillate formed during the Mannich reaction, which allows for a consistent product ratio in a batch or continuous process manufacturing environment. Typical Mannich processes can yield variations in the product mixture based on the distillation of water and the co-distillation of the more volatile starting materials with the water. The use of pre-formed triazine, such as pre-formed DMAPA-triazine as above, may yield a consistent product mixture because the loss of starting materials is negligible in the overhead during the process, thereby minimizing the problem of solvent disposal.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

It will be apparent to those skilled in the art that various modifications and variations can be made to various embodiments described herein without departing from the spirit or scope of the present teachings. Thus, it is intended that the various embodiments described herein cover other modifications and variations within the scope of the appended claims and their equivalents.

What is claimed is:

1. A process for preparing a Mannich product, comprising:

reacting a primary amine with an aldehyde to yield an optionally-substituted triazine; and reacting the optionally substituted triazine with an optionally substituted hydroxyaromatic compound to yield a Mannich product, wherein water is removed from the reaction mixture prior to the reaction of the optionally substituted triazine with the optionally substituted hydroxyaromatic compound.

2. A process for preparing a Mannich product, comprising reacting N,N-dimethyl-1,3-propane diamine with formaldehyde to yield 1,3,5-tris(3-(dimethylamino)propyl) hexahydro-1,3,5-triazine; and reacting said 1,3,5-tris(3-(dimethylamino)propyl) hexahydro-1,3,5-triazine with a polyisobutylcresol to yield the Mannich product, wherein water is removed from the reaction mixture prior to the reaction of 1,3,5-tris(3-(dimethylamino)propyl) hexahydro-1,3,5-triazine with polyisobutylcresol.

* * * * *